United States Patent [19]

Greene

[11] Patent Number: 4,897,207

[45] Date of Patent: Jan. 30, 1990

[54] MULTI-PURPOSE FORMULATIONS

[75] Inventor: Jay S. Greene, Accokeek, Md.

[73] Assignee: Environmental Security Incorporated, Gloucester, Mass.

[21] Appl. No.: 695,349

[22] Filed: Jan. 28, 1985

[51] Int. Cl.[4] ..... A62D 1/00; A62C 1/00; A62C 3/00

[52] U.S. Cl. ..... 252/2; 252/7; 252/8.05; 252/355; 252/602; 169/46; 169/47; 169/44; 169/65; 169/54

[58] Field of Search ..... 252/355, 198, 8.05; 169/47; 210/749; 239/461; 122/504

[56] References Cited

U.S. PATENT DOCUMENTS

| | | | |
|---|---|---|---|
| 1,125,642 | 1/1975 | Blanchard et al. | 239/461 |
| 3,565,801 | 2/1971 | Birchall | 252/8.05 |
| 3,637,022 | 1/1972 | Kelley et al. | 252/8.05 |

FOREIGN PATENT DOCUMENTS 1516977 of 1978 United Kingdom .

*Primary Examiner*—Howard J. Locker
*Attorney, Agent, or Firm*—Nixon & Vanderhye

[57] ABSTRACT

A liquid composition includes as a major component thereof a detergent mixture of linear alkylate sulfonate, non-ionic detergent and lauric superamide. Depending upon the particular use of the composition, it also includes effective amounts of other components. In use for fighting Class D (burning metal) fires, the composition includes alfalfa, vitamin B-6, sodium chloride, and bicarbonate of soda and the amount of water is minimized so that it is only enough to properly mix the other components together before they are added to the detergent mixture. When used for fighting Class A and B fires, the composition includes alfalfa, vitamin B-6, bicarbonate of soda, water, and optionally bovine urine. When used for extinguishing burning coal fires, the composition includes alfalfa, vitamin B-6, and water. When used as an oil dispersant, the liquid composition includes vitamin B-6, bicarbonate of soda, water, and lemon or lime juice. The application rate of liquid composition depends upon its particular use, for instance for extinguishing Class D fires it is applied at 100% concentration, and for fighting Class B fires it is applied at a dilution rate of about 0.5–6% with water.

10 Claims, No Drawings

MULTI-PURPOSE FORMULATIONS

BACKGROUND AND SUMMARY OF THE INVENTION

U.S. Pat. No. 4,248,733 discloses a liquid composition that is very useful for cleaning up oil spills or the like, and extinguishing petroleum fires. While the materials and methods disclosed therein have recognized utility, they are not as effective as desired (or in some cases at all) in extinguishing other types of fires besides petroleum fires, or in dispersing petroleum liquid as quickly as desired.

The compositions and methods according to the present invention have been developed from the basic composition disclosed in U.S. Pat. No. 4,248,733 with a view toward greatly enhancing the diversity and the effectiveness of the material in the 4,248,733 patent.

One form of the liquid composition according to the present invention is an excellent Class A and B firefighting agent. It is capable of dilution with water at conventional dilution rates commonly employed by most firefighting equipment. It causes the fire stream to be heavier and this prevents premature breakup of the water stream when very hot fires are being fought. For solid material fires, it causes the water to penetrate the natural fiber faster and reach deep-seated fires more efficiently, thereby reducing the amount of liquid per unit time required to extinguish the fire. In liquid fuel fires, it cuts off the oxygen to the fuel thereby breaking the fire chain reaction and cooling the surface by absorbing heat, and changing the surface of the material so as to break down the hydrocarbon chain making the molecules on the surface essentially non-combustible. It prevents re-ignition in most circumstances, diminishes and breaks up fire gases when vapor comes into contact with smoke, and helps prevent spalling and cracking due to absorption into block, brick, concrete slabs, and like porous material. It is utilizable with all types of existing equipment, stationary and mobile, including eductor systems, diaphragm system, sprinkler systems, hand-held hoses and extinguishers, and the like.

Another form of the liquid composition according to the present invention is useful in concentrated form for fighting Class D (burning metal) fires, and in diluted form for fighting Class B fires. It is the only known liquid firefighting agent that can successfully extinguish Class D fires. It is capable of absorbing a tremendous heat production from combustible metals without turning into gas and separating as other liquid agents do when they come in contact with burning combustible metals. Its heat absorption ability is approximately 7.7 million BTUs per pound, compared to 1,142 BTUs per pound for water. It may be applied with any standard mobile or fixed firefighting equipment utilizing a wide angle fog nozzle, or sprinkler system head. When used for extinguishing Class B fires, it is mixed with water at a rate of about 0.5–2% (e.g., 1.5%) and sprayed, onto the fire preferably in a fog pattern at a pressure of about 50–200 pounds per square inch. Extinguishing time is typically about 15–70 seconds, and it greatly minimizes the chance of re-ignition, and requires a low effective application rate.

Yet another form of the liquid composition according to the present invention is ideally suited for dispersing petroleum liquids polluting environmental systems, such as salt water, fresh water, or land. Generally, one application of the agent mixed with water will cause the dispersal and elimination of 4% of the polluting petroleum liquid per 24 hours after application is complete. Continued reaction can be expected for up to about a week without reapplication, and application can be repeated. The composition generally operates first as an emulsifier causing the density of the oil or other petroleum product to decrease very dramatically, and then starts to demulsifiy. In water this causes the oil to surface at a lower weight density. Both emulsification and demulsification continue until the oil is totally eliminated as a hydrocarbon. On land, the agent may be used to dislodge heavy oil buildup with the effect of making clean up with a vacuum system more effective and quicker. It also can be used to clean oil soaked birds and animals without harming them. For water spills, liquid composition is typically metered at a dilution rate of about 10–25% with water, and is spread as evenly as possible. Heavy initial application is avoided, and reapplication can be provided as necessary. On land, it is metered at about a rate of 25% to water, and for cleaning birds and animals is metered to water at a rate not to exceed 6%. It also will extinguish a fire on an oil slick, but should be used only with fires involving heavy oils. Any existing fire pumping equipment can be utilized to apply a dispersant, as may most hoses or pipe systems now in use to dispense metered amounts of liquids.

DETAILED DESCRIPTION OF THE INVENTION

The liquid formulation according to the present invention comprises a detergent mixture comprising alkylate sulfonate, non-ionic detergent and lauric superamides, as the major active component thereof. An effective amount of other materials are also added to the detergent mixture depending upon the particular use. All materials employed in the liquid composition according to the invention are non-toxic so that they may be used in essentially any environmental system.

The liquid formulation of the invention includes vitamin B-6. The vitamin B-6 acts as a densifier, and for fire fighting application increases the heat absorption capability of the detergent mixture.

For all the firefighting applications of the liquid composition according to the invention, alfalfa is also utilized as a component of the formulation. The alfalfa slows down the emulsification rate of the detergent mixture so that the detergent suds stay on the surface longer. The alfalfa also has a minor densifying action (that is, it intensifies the sudsy surface a small amount).

For all the uses of the liquid composition according to the invention except for the coal fire extinguishing use, bicarbonate of soda is also a significant component of the formulation. The bicarbonate of soda agitates the detergent mixture so that it suds more quickly, and acts as a stabilizer. In general, it helps prevent burn-through in firefighting applications.

For the Class B and D firefighting applications, particularly the Class D firefighting applications, a significant component of the liquid formulation comprises sodium chloride. Sodium chloride densifies the detergent mixture, and prevents it from separating and detonating in Class D fires. It partially dissolves in the detergent mixture down to the molecular level, and will not itself cause detonation. Other commonly-recognized Class D agents are not as effective, nor are other salts such as potassium chloride (e.g., potassium will burn when exposed to a burning combustible metal).

For the oil dispersing uses, lemon or lime juice is added to the liquid formulation. Lemon or lime juice is added since they are the most practical non-toxic (and environmentally sound) defoamers. They speed up the emulsification reaction (and thus in the oil dispersing applications the alfalfa is eliminated since it slows down the emulsification reaction).

Water is also a significant component of each of the liquid formulations except for the Class D firefighting composition. The water is provided to increase cost effectiveness, and to reduce the weight of the final product. Also, the water is added so as to provide adjustment of the volumetric quantity of the liquid composition so that it can be applied at conventional dilution rates utilizing conventional equipment. For the Class D firefighting agent, the amount of water is minimized since water will cause the agent to be less effective and may cause separation or detonation. Only enough water is added to the components, besides the detergent mixture, so that they can be mixed properly prior to addition to the detergent mixture during production of the liquid formulation.

In all cases, non-toxic and (in the case of the firefighting applications) low flammability, coloring and perfuming agents are added so that the liquid formulation does not have an objectionable appearance or odor. The most suitable coloring material is standard vegetable color (such as blue vegetable color for the oil dispersing material), and the best known perfuming agent is eucalyptus oil. These materials are typically added so that their combined total contribution to the liquid formulation is less than about 4% by weight of the detergent mixture.

For the Class A and B firefighting agent, bovine urine is an optional component thereof. When utilized, the bovine urine provides uric acid which helps in the sudsing action of the detergent mixture, which sudsing action prevents oxygen from getting to the combustible material.

General characteristics and functions of the various forms of the liquid composition of the present invention having been described, details of the compositions thereof and methods of utilization thereof will now be described. In the following description, except where indicated, the expression "by weight" is expressed as a percentage of the weight of the detergent mixture of alkylate sulfonate, nonionic detergent and lauric superamide. For example, if the alfalfa contribution to the liquid composition is indicated as 3–10% by weight, this means that the amount of alfalfa is from 3% of the weight of the detergent mixture component of the composition, to 10% by weight of the detergent mixture contribution to the composition.

In the following descriptions also, the liquid formulation may comprise, consist of, or consist essentially of the indicated components.

Class A and B Firefighting Agent

This liquid composition will typically be applied at a dilution of rate of about 3–6%, and the listing of the quantities of ingredients herein is made with such a dilution rate in mind. Of course, for other dilution rates, the same agent components can be utilized, with adjustments in the quantities and/or percentages of each corresponding to the other desired dilution rates. The agent may be used with all types of conventional firefighting equipment, and is preferably applied at any pressure from about 20 pounds per square inch—400 pounds per square inch. The agent can totally extinguish essentially all Class A and B fires in 9–90 seconds, including natural wood, plywood, particle board, plastic building products, roofing materials, crude oil, motor oil, jet fuel, fuel oil, kerosene, diesel oil, and gasoline fires.

This liquid composition preferably comprises the following composition of ingredients:

- Detergent mixture of alkylate sulfonate, nonionic detergent and lauric superamide, about 22–45% by volume of the total liquid composition;
- Alfalfa—about 3–10% by weight;
- Vitamin B-6, 0.5–1.5% by weight;
- Bicarbonate of soda—about 0.25–18% by weight;
- Bovine urine—0–10% by weight; and
- Water, about 50% by volume (variable depending upon specific dilution rate).

Also, the color and odor of the liquid composition are usually desirably adjusted, as by providing 0.25–1% by weight vegetable color, and 1–2% by weight eucalyptus oil.

EXAMPLE I

A liquid formulation of Class A and B firefighting agent was produced by mixing all of the components except for the detergent mixture and vegetable color with water, and then pouring the detergent and vegetable color over the mixture while stirring. After mixing is complete, the formulation included, per 4.1 pounds of detergent mixture, 1% bovine urine, 0.25% vegetable color, 1.8% eucalyptus oil, 3% alfalfa, 1% vitamin B-6, and 12% bicarbonate of soda, with about one-half of the total volume of liquid composition being water. This liquid composition was used to extinguish a number of different types of Class A and B fires, with the results indicated in Tables I and II:

TABLE I

| Test Number | 1 | 2 | 3 | 4 | 5 | 6 |
|---|---|---|---|---|---|---|
| Depth, Fuel-Before | 2" | 2" | 2" | 2.5" | 12 C/F | 19.6 C/F |
| Depth, Fuel-After | 1⅞" | 1 15/16" | 1 15/16" | 2 7/16" | 9.25 C/F | 18 C/F |
| Total Sq. Footage | 10 | 10 | 10 | 10 | 3.75 C/F | 1.64 C/F |
| Total BTU Output | 901,440 | 901,440 | 901,440 | 901,440 | 5,030,662 | 29,520 |
| Total So. Used | 63 oz | 41 oz | 42 oz | 25 oz | 256 oz | 236 oz |
| % Concentration of Agent | 6 | 3 | 2 | 1 | 10 | 6 |
| % Sol. Per Sq. Ft. | 6.3 oz | 4.1 oz | 4.2 oz | 2.5 oz | 75 oz | 12 oz |
| % Con. Per Sq. Ft. | .378 oz | .123 oz | .084 oz | .025 oz | 6.9 oz | .722 oz |
| Total Con. Used | 3.78 oz | 1.23 oz | .84 oz | .25 oz | 26 oz | 14.16 oz |
| Gallons Per Min. | 1.9 | 1.9 | 1.9 | 1.9 | 1.9 | 1.9 |
| Extinguishing Sys. | W/P | W/P | W/P | W/P | W/P | W/P |
| Nozzle Pressure | 1.1 | 1.1 | 1.1 | 1.1 | 1.1 | 1.1 |
| Velocity of Dis. | 12.7 | 12.7 | 12.7 | 12.7 | 12.7 | 12.7 |
| Air Temperature (°F.) | 48 | 48 | 53 | 53 | 48 | 57 |

TABLE I-continued

| Test Number | 1 | 2 | 3 | 4 | 5 | 6 |
|---|---|---|---|---|---|---|
| Type of Fuel | Oil #6 | Oil #6 | Oil #6 | Oil #6 | Coal/A | Tires |
| Time of Ignition | 1141 | 1221 | 1259.31 | 1327.40 | 0920 | 1410 |
| Dur. of Ext-Start | 1143 | 1222.11 | 1300.50 | 1328.12 | 1425 | 1413 |
| Dur. of Ext-Finish | 1143.16 | 1222.24 | 1301.03 | 1328.22 | 1430 | 1413.16 |
| Time to Extinguish (in minutes) | 0.16 | 0.13 | 0.13 | 0.10 | 5 | 0.36 |
| Density Per Sq. Ft. | .043 | .028 | .029 | .017 | 2.0 | 1.84 |

TABLE II

| Test Number | 7 | 8 | 9 | 10 | 11 |
|---|---|---|---|---|---|
| Depth, Fuel-Before | "2 | 4' | 4" | 2" | 3" |
| Depth, Fuel-After | 1 15/16" | 3⅞" | 3⅞" | .5" | 2½" |
| Total Sq. Footage | 10 | 5.25 | 5.25 | 5.25 | 5.25 |
| Total BTU Output | 457,700 | 624,000 | 624,000 | 752,000 | 640,000 |
| Total, Sol. Used | 128 oz | 96 oz | 56 oz | 102 oz | 44 oz |
| % Concentration | 3 | 100 | 3 | 3 | 3 |
| % Sol. Per Sq. Ft. | 12.6 | 6 | 10.5 | 19.43 | 8.34 |
| % Con. Per Sq. Ft. | .04 | 6 | .32 | .59 | .25 |
| Total Con. Used | 4 oz | 32 oz | 1.68 oz | 3.06 | 1.32 |
| Galls Per Min. | 5.45 | 5.45 | 5.45 | 5.45 | 5.45 |
| Extinguishing Sys. | W/P | W/P | W/P | W/P | W/P |
| Nozzle Pressure | 20 | 20 | 20 | 20 | 20 |
| Velocity of Dis. | 56 | 56 | 56 | 56 | 56 |
| Air Temperature (°F.) | 70 | 74 | 74 | 77 | 54 |
| Type of Fuel | Diesel | Kero-sene | Kero-sene | Gas | Diesel |
| Time of Ignition | 1457.11 | 1613 | 1634 | 1345 | 1550 |
| Dur. of Ext-Start | 1458.44 | 1613.32 | 1634.25 | 1345.20 | 1551.32 |
| Dur. of Ext-Finish | 1458.55 | 1613.50 | 1634.45 | 1353 | 1552.13 |
| Time to Extinguish (in minutes) | 0.11 | 0.18 | 0.20 | 7.80 | 0.81 |
| Density Per Sq. Ft. | .1 | .08 | .08 | .18 | .058 |

Class B and D Firefighting Agent

The same basic firefighting agent can be formulated for both Class B and D fires. For Class D fires, however, it is applied at essentially 100% concentration. If water is added, it will decrease effectiveness and may cause separation and detonation. It is applied at a system pressure desirably no less than 50 pounds per square inch, and preferably with the range of about 50–200 pounds per square inch. It is desirably not applied with a straight stream nozzle as the pressure of any stream against the combustible metal tends to cause hot metal fragments to be dispersed in all directions. It is best applied with a wide angle fog nozzle, or existing sprinkler systems which have heads which will break up the liquid stream into a dispersed pattern.

When used for fighting Class B fires, it is mixed with water prior to application to the fire, at a dilution rate of about 0.5–2% of water (e.g., 1.5%). It is preferably applied with a minimum system pressure of 60 pounds per square inch, and preferably is applied with a fog nozzle although a straight stream may be utilized where the firefighting equipment is at a great distance from the fire.

Typical concentration ranges for this liquid formulation are:

detergent mixture—about 39–67% of the total mass;
alfalfa—about 3–7% by weight;
Vitamin B—6—0.5–3% by weight; NaCl—about 25–41% by weight;
bicarbonate of soda—about 1–18% by weight;
water (minimum to mix)—about 3–7% by weight;
Where desired:
vegetable color—about 0.5% by weight eucalyptus oil—about 0.25–1.5% by weight.

EXAMPLE II

A Class D firefighting liquid composition was formulated by mixing 8.25 pounds of detergent mixture with other components. Three percent by weight alfalfa, 1% by weight eucalyptus oil, 0.5% by weight vegetable color, 1% by weight vitamin B-6, 30% by weight sodium chloride, and 12% by weight bicarbonate of soda were mixed with a minimum amount of water, only enough to provide effective mixing of the components. The amount of water sufficient to do this would typically be about 3–7% by weight, with mixing taking place until there are no lumps. The detergent mixture and vegetable color is then added to the other components, and mixing continues until a homogeneous product is produced. This product is then suitable for direct application to Class D fires by spraying in on the fires with a fog nozzle. Table III indicates the results of tests performed utilizing this liquid formulation:

TABLE III

| Test Number | 1 | 2 | 3 |
|---|---|---|---|
| Type of Fuel | Magnesium | Zerconium | Zerconium& Magnesium |
| Weight of Fuel | 2 Lbs | 1.5 Lbs | 1½ Lbs & 2 Lbs |
| Total BTU Output | 23900 | Unk. | Unk. |
| Total Agent Used | 1 Gal | 1 Gal | 1 Gal |
| Concentration | 100% | 100% | 100% |
| Gallons Per Min. | 2.61 | 2.61 | 2.61 |
| Extinguishing Sys. | W/P | W/P | W/P |
| Velocity of Discharge | 27 ft/min | 27 ft/min | 27 ft/min |
| Nozzle Pressure | 4 PSI | 4 PSI | 4 PSI |
| Temperature (°F.) | 48 | 56 | 58 |
| Humidity | 60% | 50% | 50% |
| Pre-Burn Time | 1.50 Min. | 6 Min. | 2 Min. 18 Sec. |
| Time to Extinguish | 32 Sec | 68 Sec | 38 Sec |
| Amount Per Lb | 1 Gal | .75 Gal | .29 Gal |
| Amount of Water Added | 0 | 0 | 0 |

Oil Dispersant

Another form of the liquid composition according to the invention is useful in dispersing petroleum liquid spills, whether in salt or fresh water or on land. For water application, the first application typically is at metered rate to water of about 25% (e.g., about 10–25%), and it is sprayed over the petroleum liquid as evenly as possible. After a 24-hour delay, reapplication can be made at a metered rate to water of about 10%. For land use, the liquid composition is applied at a metered rate of about 25% to water, and after about an hour or several hours, vacuum operations can be begun. The application at the same rate is made as necessary to complete clean-up.

For cleaning birds and animals, the liquid composition is metered to water at rate not to exceed 6%. All water fowl must be thoroughly rinsed off with clean water after treatment. Application can be made with any standard firefighting equipment, sludge and bilge pumps, and the like.

A typical liquid composition of the oil dispersant is:

detergent mixture, 50% by volume of the total composition;

vitamin B-6, about 3–10% of the total mixture, by weight;

bicarbonate of soda, about 1–7% of the total mixture by weight;

lemon or lime juice, about 1–3% of the total mixture by weight;

water, about 26–44% by volume of the total mixture; and where present, vegetable color (e.,g., blue) is 0.1–1% by weight of the total mixture, and eucalyptus oil is about 1–3% by weight of the total mixture.

EXAMPLE III 4.1 pounds of detergent mixture and 0.25% by weight blue vegetable dye were combined with 1% lemon juice, 7% bicarbonate of soda, 3.5% vitamin B-6, and 1% eucalyptus oil. The eucalyptus oil, vitamin B-6, bicarbonate of soda, and lemon juice were mixed with water, and after thorough mixing, the detergent mixture and vegetable color were added. The resulting liquid composition was applied to an oil spill, and successfully effected dispersing of the oil after initial application, and several reapplications.

It will be thus be seen that according to the present invention a liquid formulation having excellent effectiveness for a wide variety of uses has been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompasss all equivalent compositions and methods.

What is claimed is:

1. A method of formulating a Class D firefighting agent which includes a detergent mixture comprising an alkylate sulfonate, non-ionic detergent and lauric superamide, comprising the steps of:

adding amounts of, vitamin B-6, sodium chloride and bicarbonate of soda effective when, in formulation, to put out a Class D fire, to a minimum amount of water sufficient to facilitate mixing of the components;

mixing the, vitamin B-6, sodium chloride, bicarbonate of soda, and water together so that substantially no lumps exist and a generally homogeneous slurry is provided; and then mixing the slurry with the detergent mixture so as to provide a homogeneous Class D firefighting agent.

2. A method of formulating a Class B firefighting agent by formulating a Class D firefighting agent as recited in claim 1; and then before application to a fire, diluting the firefighting agent with water at a dilution rate of about 0.5–2% agent to water.

3. A method of extinguishing a combustible metal fire comprising the step of:

applying directly to the fire a liquid composition comprising a major part of detergent mixture of linear alkylate sulfonate, non-ionic detergent and lauric superamide, and amounts of materials effective when, in formulation, to put out a combustible metal fire, for: slowing down the detergent mixture and emulsification rate; densifying and increasing the heat absorption capability of the detergent mixture; agitating and stabilizing the detergent mixture; and densifying and preventing separation and detonation of the detergent mixture when exposed to burning metal.

4. A method as recited in claim 13 wherein said applying step is accomplished by spraying the liquid composition, without significant water addition, directly onto the burning metal.

5. A method as recited in claim 4 wherein in the liquid composition the detergent mixture comprises about 39–67% of the total mass; and wherein the other components consist essentially of: alfalfa in an amount of about 3–7% by weight of the detergent mixture; vitamin B-6 in an amount of 0.5–3% by weight of the detergent mixture; sodium chloride in an amount of about 25–41% by weight of the detergent mixture; and bicarbonate of soda in an amount of about 1–18% by weight of the detergent mixture; with small amounts of non-toxic, relatively low flammability, coloring and perfuming agents as desired.

6. A formulation for use as a Class D firefighting agent and comprising a mixture of:

a linear alkylate sulfonate, non-ionic detergent and lauric superamide detergent mixture comprising about 39–67 percent of the total mass of the formulation;

vitamin B-6 in the amount of 0.5–3 percent by weight of the detergent mixture;

sodium chloride in the amount of about 25–41 percent by weight of the detergent mixture;

bicarbonate of soda in the amount of about 1–18 percent by weight of the detergent mixture; and a volume of water large enough only to provide effective mixing of the other components of the formulation and insufficiently large to interfere with the use of the formulation as an effective Class D firefighting agent.

7. A formulation as recited in claim 6 further comprising alfalfa in the amount of about 3–7% by weight of the detergent mixture.

8. A formulation for use as a Class B firefighting agent, for application with water at a dilution rate of about 0.5–2 percent to water, the mixture comprising:

a linear alkylate sulfonate, non-ionic detergent and lauric superamide detergent mixture comprising about 39–67 percent of the total mass of the formulation;

alfalfa in the amount of about 3–7 percent by weight of the detergent mixture;

vitamin B-6 in the amount of about 0.5–3 percent by weight of the detergent mixture;

sodium chloride in the amount of about 25–41 percent by weight of the detergent mixture; and bicarbonate of soda comprising about 1–18 percent by weight of the detergent mixture.

9. A method as recited in claim 4 wherein in the liquid composition the detergent mixture comprises about 39–67% of the total mass; and wherein the other components consist essentially of: vitamin B-6 in an amount of 0.5–3% by weight of the detergent mixture; sodium chloride in an amount of about 25–41% by weight of the detergent mixture; and bicarbonate of soda in an amount of about 1–18% by weight of the detergent mixture; with small amounts of non-toxic, relatively low flammability, coloring and perfuming agents as desired.

10. A method of extinguishing a Class B fire comprising the steps of:

mixing with water a liquid composition comprising a detergent mixture of alkylate sulfonate, non-ionic detergent and lauric superamide, in an amount of about 39–67 percent of the total mass of the liquid composition; alfalfa in the amount of about 3–7 percent by weight of the detergent mixture; vitamin B-6 in an amount of 0.5–3 percent by weight of the detergent mixture; sodium chloride in an amount of about 25–41 percent by weight of the detergent mixture; and bicarbonate of soda in an amount of about 1–18 percent by weight of the detergent mixture;

adding the liquid composition to water at a dilution rate of about 0.5–2 percent to water; and spraying the liquid composition and water directly onto a Class B fire.

* * * * *